United States Patent [19]

Oliver

[11] 4,143,575

[45] Mar. 13, 1979

[54] ELECTRONIC SOUND GENERATING SYSTEM FOR A STRINGED MUSICAL INSTRUMENT

[76] Inventor: Richard C. Oliver, 8504 W. 125 N., West Lafayette, Ind. 47906

[21] Appl. No.: 728,865

[22] Filed: Oct. 1, 1976

[51] Int. Cl.[2] ..... G10H 1/00

[52] U.S. Cl. ..... 84/1.16; 84/DIG. 27

[58] Field of Search ..... 84/1.01, 1.14–1.16, 84/DIG. 27

[56] References Cited

U.S. PATENT DOCUMENTS

| | | | |
|---|---|---|---|
| 2,220,350 | 11/1940 | Purington | 84/1.14 |
| 2,273,975 | 2/1942 | Miessner | 84/1.14 |
| 2,314,496 | 3/1943 | Hammond | 84/1.14 |
| 2,318,936 | 5/1943 | Fisher | 84/1.14 X |
| 2,323,232 | 6/1943 | Miessner | 84/1.16 X |
| 2,817,261 | 12/1957 | Fender | 84/1.16 |
| 2,896,491 | 7/1959 | Lover | 84/1.16 |
| 3,456,063 | 7/1969 | Tekanishi et al. | 84/1.16 |
| 3,767,833 | 10/1973 | Noble et al. | 84/101 |
| 3,781,451 | 12/1973 | Nelan | 84/1.16 |
| 4,010,608 | 3/1977 | Plueddemann | 84/1.16 |

*Primary Examiner*—James R. Scott
*Assistant Examiner*—Vit W. Miska
*Attorney, Agent, or Firm*—John R. Nesbitt

[57] ABSTRACT

An electronic sound generating system is disclosed for use with a stringed musical instrument such as a guitar. An RF oscillator is connected with an electrically conductive string of the instrument and a pickup coil is positioned adjacent to the string so that RF signals of varying amplitude are induced in the coil due to vibration of the string resulting from playing of the instrument. The variable amplitude RF signals are detected and an audio signal produced therefrom that is coupled to a speaker, for example. A stereo output can be provided by placing dual pickup coils adjacent to the string with the pickup coils being positioned normal to one another. Each string of the musical instrument can be separately provided with an RF current of a common frequency or different frequencies. A separate pickup coil is provided for each string, with two such coils being provided for each string if the output is to be a stereo output, and the signals from the pickup coils are processed in separate channels each of which includes a filter tuned to the frequency of the RF signal impressed on the associated string. Thus, separate audio outputs from each string are available for independent signal processing. Conventional techniques may therefore be employed to produce effects normally associated with electronic music synthesizers. In addition, a vibration sustaining device can also be utilized for each string to continue or alter vibration of the string.

17 Claims, 11 Drawing Figures

ELECTRONIC SOUND GENERATING SYSTEM FOR A STRINGED MUSICAL INSTRUMENT

FIELD OF THE INVENTION

This invention relates to an electronic sound generating system and, more particularly, relates to a sound generating system for a stringed musical instrument such as a guitar.

BACKGROUND OF THE INVENTION

As is well known, it is often desirable that the sound produced by a musical instrument be sensed and the sound reproduced with a different characteristic such as a higher volume.

With a stringed instrument such as a guitar, for example, various types of systems have heretofore been suggested and/or utilized for picking up the produced sounds and then reproducing them at higher volume. Included in such arrangements have been guitar pickups of the magnetic type positioned to detect variations produced by the strings of a guitar and generating electrical signals in response thereto.

Prior systems, however, while utilizing RF frequencies for transmission of signals after developing of the same by pickup coils, have not been successful in utilizing RF frequencies as a part of the pickup technique. The use of such a technique, however, has the advantage of substantially eliminating hum due to 60 hertz line frequencies and facilitating the maintenance of separate signals for each string of a multi-stringed instrument such as is the conventional guitar.

SUMMARY OF THE INVENTION

This invention provides an electronic sound system for a stringed musical instrument that utilizes RF frequencies as a part of the pickup technique. In addition, a sound system is provided that maintains signal separation between a plurality of signals derived from separate strings of a multi-stringed instrument and enables a stereo output to be produced for each string. Provision is also made to sustain vibrations of a string to enhance system sound reproduction.

It is therefore an object of this invention to provide an electronic sound system for a stringed musical instrument.

It is another object of this invention to provide an electric sound system for a stringed musical instrument that utilizes RF frequencies.

It is still another object of this invention to provide an electronic sound system for a stringed musical instrument that maintains signal separation between a plurality of signals derived from separate strings of a multi-stringed instrument.

It is yet another object of this invention to provide an electronic sound system for a stringed musical instrument that provides a stereo output.

It is still another object of this invention to provide an electronic sound system for a stringed musical instrument that includes means to sustain the vibrations of the strings of the instrument.

With these and other objects in view, which will become apparent to one skilled in the art as the description proceeds, this invention resides in the novel construction, combination, and arrangement of parts substantially as hereinafter described, and more particularly defined by the appended claims, it being understood that such changes in the precise embodiment of the herein disclosed invention are meant to be included as come within the scope of the claims.

BRIEF DESCRIPTION OF THE DRAWINGS

The accompanying drawings illustrate complete embodiments of the invention according to the best mode so far devised for the practical application of the principles thereof, and in which.

DESCRIPTION OF THE INVENTION

Figure 1:
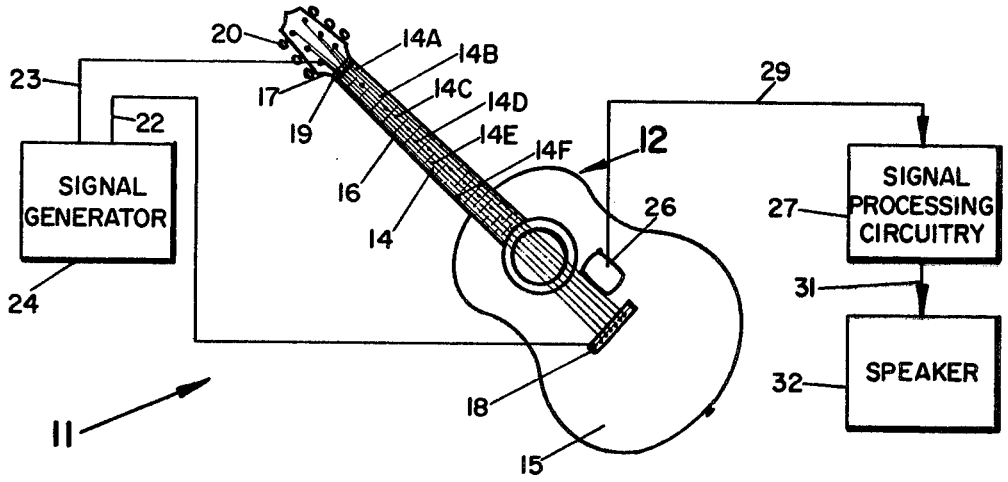
FIG. 1 is a top view illustration of the sound system of this invention shown utilized with a guitar as the musical instrument.

Referring now to the drawings, the numeral 11 indicates generally the preferred embodiment of the sound system of this invention shown utilized in FIG. 1 with a conventional guitar 12 as the musical instrument (which guitar may be, for example, a base guitar), although the invention can be utilized with any musical instrument having electrically conductive strings. While only one string 14 of guitar 12 is shown in FIG. 2 for illustrative purposes, it is to be realized, of course, that such a guitar would normally include a plurality of strings (such as strings 14A, 14B, 14C, 14D, 14E and 14F as indicated in FIG. 1, for example) and that such strings can be electrically conductive, such as metallic strings as are conventional.

As is conventional, guitar 12 includes a body 15, a neck 16, and a head 17. Strings 14 are conventionally secured at one end above body 15 by means of bridge 18, which bridge is conventionally fastened to the body 15 of the guitar. The other end of each string passes over a bridge 19 at head 17 of the guitar and is connected to tuning screw 20 at head 17 of the guitar. Obviously, the vibrating portion of the string between bridges 18 and 19 is thus held elevated above the body, head and neck of the guitar.

The conventional guitar, as briefly described hereinabove, has the sound system 11 of this invention associated therewith. String 14 is connected at opposite ends with electrical leads 22 and 23, which leads are connected with a signal generator (such as an RF oscillator) 24. RF oscillator 24 may be conventional and produces an RF output signal at a predetermined RF frequency with the output signal having a constant amplitude. By operating at RF frequencies rather than at audio frequencies, the problem of 60 hertz power line hum pickup is eliminated. This output from oscillator 24 is coupled through leads 22 and 23 to impress an RF current of constant amplitude on string 14.

Figure 2:
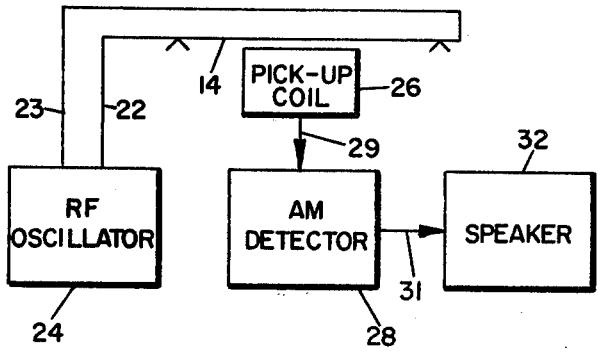
FIG. 2 is a block diagram showing the sound system of the invention associated with a single string of a musical instrument.
Figure 3:
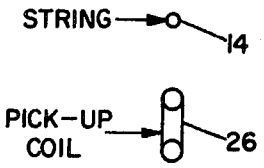
FIG. 3 is a partial cross-section view of the pickup coil and string as shown in FIG. 2 illustrating positioning of the coil with respect to the string.

A sensor (such as a conventional pickup coil) 26 is positioned adjacent to a portion of string 14, as shown in FIGS. 1 and 2. The positioning of the pickup coil is such that the coil is inductively coupled to the adjacent string. Mechanical motion or vibration of the string varies the amount of inductive coupling between the string and the coil causing amplitude variations in the RF signal induced in the coil. A preferred positioning of coil 26 with respect to string 14 is shown by FIG. 3, and as can be seen therefrom the extended plane of the coil preferably intersects string 14.

As shown in FIG. 1, the varying amplitude RF signal induced in pickup coil 26 is conducted to signal processing circuitry 27, which circuitry includes an AM detector 28 (see FIG. 2), with the pickup coil being connected with the processing circuitry through electrical lead 29. AM detector 28 may be of conventional design and may include an audio amplifier (not shown). The output of the AM detector is an audio signal which corresponds to the mechanical vibration of the string, and it may be used in any way desired such as, for example, by being coupled on lead 31 to drive a conventional speaker 32 (as indicated in FIGS. 1 and 2).

Figure 4:
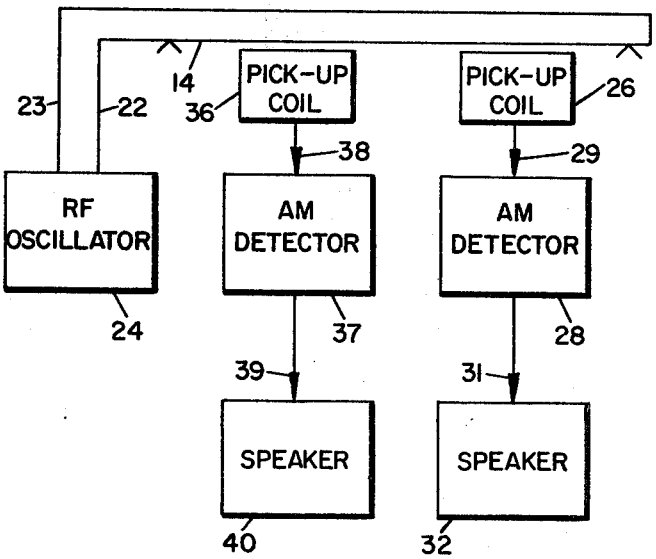
FIG. 4 is a block diagram showing the sound system of the invention utilizing dual pickup coils associated with a single string of a musical instrument and providing a stereo output.

As shown in FIG. 4, the sound system of this invention may be utilized to produce a stereo output. As shown, RF oscillator 24 is connected with string 14 in the same manner as described hereinabove in connection with the embodiment shown in FIG. 2.

Figure 5:
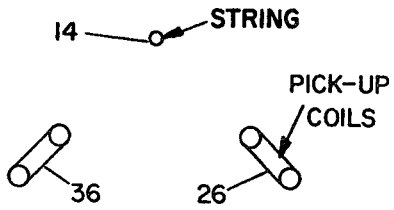
FIG. 5 is a partial cross-section view of the dual pickup coils and string as shown in FIG. 4 illustrating positioning of the coils with respect to said string and to one another.

In addition, as also shown in FIG. 4, pickup coil 26 is positioned in the same manner as described hereinabove in connection with the embodiment as shown in FIG. 2, and the output therefrom is coupled in the same manner to AM detector 28. As shown in FIG. 4, however, a second sensor (pickup coil 36) is provided the output of which is coupled to a second AM detector 37 through electrical lead 38. The output from AM detector on lead 39 may be used to drive speaker 40, while the output from AM detector 28 on lead 31 may be used to drive speaker 32 (both outputs being amplified, if desired). Pickup coil 36 may be identical to pickup coil 26 but is positioned with the plane of the coil normal to the plane of coil 26, as is shown by the partial cross-section view of FIG. 5.

With the coils 26 and 36 positioned at right angles with respect to one another, each reproduces only those vibrations in its respective plane. This results in both coils reproducing the vibrations of string 14 with its characteristic frequency, but the relative phases and amplitudes are dependent on the angle of mechanical vibration of the string with respect to coils 26 and 36. This pickup technique is therefore somewhat analogous to a technique employed in conventional stereo phonograph pickups, however, in this case, the pickup is directly from the string itself. In this respect, the stereo output is compatible with conventional matrix-type quadriphonic decoders, and, when reproduced through such a system, the variations in phase and amplitude between channels would be perceived by a listener as changes in direction of the sound. It is important that the pickup be of the RF type since the magnetic fields of conventional pickups would interact and allow little, if any, separation between channels.

Figure 6:
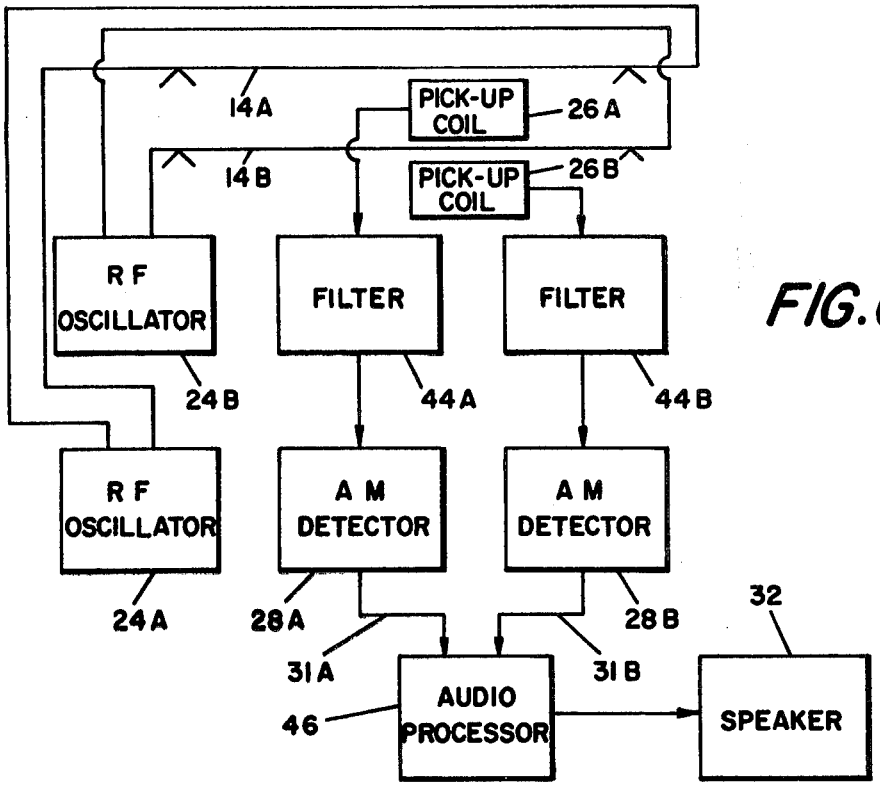
FIG. 6 is a block diagram showing the sound system of this invention associated with a plurality of strings of a musical instrument.
Figure 7:
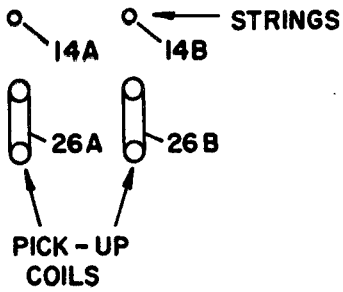
FIG. 7 is a partial cross-section view of the pickup coils and associated strings illustrating relative positioning of the same.

As shown in FIG. 6, each string of a multiple-string instrument may be connected with a different RF oscillator (only two strings 14A and 14B have been shown connected with oscillators 24A and 24B in the illustration of FIG. 6) with each oscillator producing an output signal at a different RF frequency. while fewer oscillators or even a single oscillator may be used to place RF signals on the strings, the recovered audio signals would lack separation thus compromising the performance of the system, as will become clear. Each string (14A and 14B) has a different pickup coil 26 (designated as pickup coils 26A and 26B in FIG. 6) positioned adjacent thereto so that each coil is inductively coupled with a separate string, as is indicated in FIG. 7. In like manner, additional strings could be connected so that a guitar with six strings, for example, could have six oscillators and six pickup coils. Obviously, each string would induce amplitude varying signals in its adjacent pickup coil. Since each pickup coil might also pick up signals induced from other strings, each channel has a filter 44 (designated as filters 44A and 44B in FIG. 6) connected between the pickup coil and the AM detector (each AM detector being designated by the numerals 28A and 28B in FIG. 6). Each filter 44 is tuned to pass essentially only the frequency of the RF oscillator connected with the string adjacent to the pickup coil associated with the filter. Thus, the output signal from each AM detector corresponds to the vibrations of its associated string only.

Each output signal (at leads 31A and 31B as shown in FIG. 6) contains a single primary frequency corresponding to the mechanical vibration of its associated string. Such a single-frequency signal can be processed in audio signal processor 46 before being combined with output signals from other strings. Such audio processing may be performed by conventional means and may, for example, include varying the amplitude, phase, and harmonic content of the signal. Frequency multiplication or division might also be employed. Therefore, a conventional guitar, for example, could be made to sound like another instrument, changed in pitch, and otherwise produce sound effects normally associated with an electronic music synthesizer. In this respect, it would be possible to design an electronic music synthesizer using a guitar, for example, instead of a keyboard as a controlling device. This versatility stems from the fact that separate outputs are provided for each string, and is a direct result of use of the RF type pickup. It would not be possible with a conventional pickup which has signals from several strings mixed together in a single output.

Figure 8:
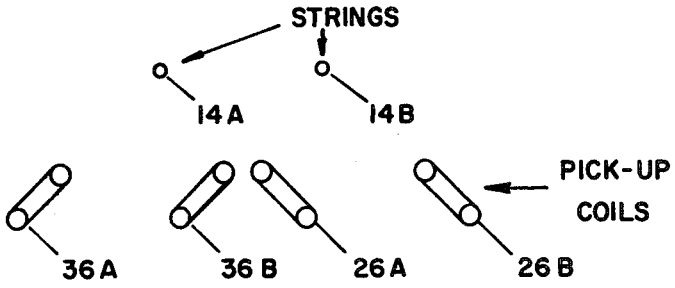
FIG. 8 is a partial cross-section view showing positioning of the pickup coils and associated strings illustrating positioning for stereo output from a plurality of strings.

While not shown in detail, the embodiment of FIGS. 4 and 6 could be combined so that a stereo output is provided for each string of the instrument. FIG. 8 shows by partial cross-section an arrangement for positioning of the pickup coils to achieve a stereo effect for multiple strings. For this embodiment, a pair of pickup coils (designated as coils 26A–36A and 26B–36B) would be positioned adjacent to each string with the outputs from each pickup coil coupled through individual filters (as described in connection with FIG. 6) to individual AM detectors (as described in connection with FIG. 4). Such a system used with a conventional six string guitar, for example, would produce six different pairs of outputs. Each pair of outputs would correspond to the mechanical vibrations of a single string with its characteristic frequency but different amplitudes and phases as described in connection with FIG. 4. Obviously, the AM detector outputs in such a system could be individually processed as described in connection with the embodiment of FIG. 6, and therefore this system also could be used as the controlling device in a music synthesizer.

Figure 9:
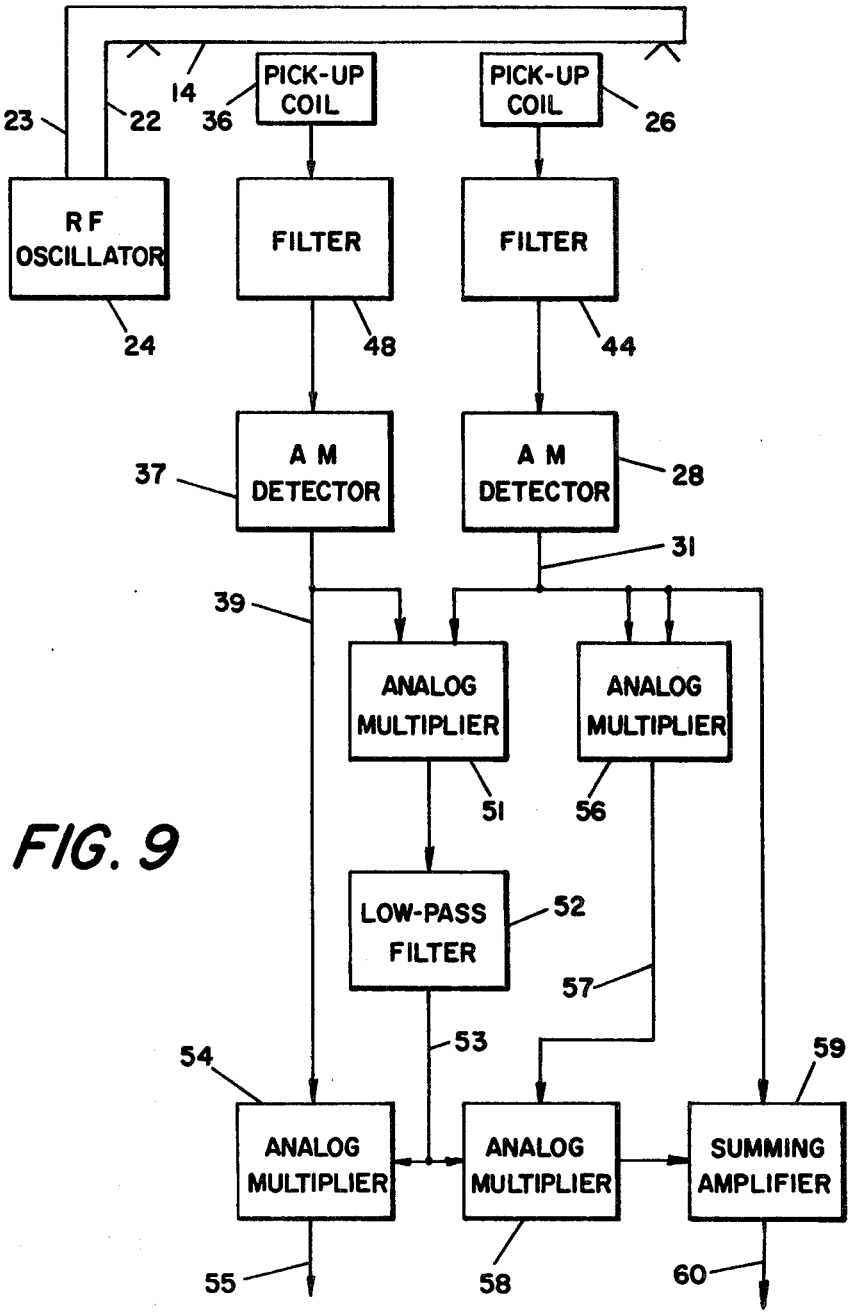
FIG. 9 is a block diagram showing the sound system of this invention utilizing dual pickup coils associated with a single string of a multiple-string musical instrument, and illustrating signal processing techniques which may be used therewith.

FIG. 9 illustrates a typical arrangement of circuitry associated with a single string of a system having multiple strings and stereo pickup coils. Pickup coils 26 and 36 are connected to AM detectors 28 and 37, as in FIG. 4, through filters 44 and 48, as in FIG. 6. As shown in FIG. 9, outputs 31 and 39 from AM detectors 28 and 37 may be channeled to the inputs of a conventional four-quadrant analog multiplier module 51, the output of which is passed through low-pass filter 52. The output on lead 53 of the low-pass filter would correspond to the difference in phase and amplitude between the signals derived from the two pickups 26 and 36, and therefore would correspond to the angle of mechanical vibration of the string.

Such a string could be used to envelope modulate one or more of the output signals, or vary their harmonic content. These are exemplary of the possible uses of the phase-related signal on lead 53 and are illustrated in FIG. 9. In the first case, the output on lead 39 and the phase-related signal on lead 53 are used as inputs of two-quadrant analog multiplier 54. The output on lead 55 would then be the output of AM detector 37 envelope modulated by the signal on lead 53. In the second case, four-quadrant analog multiplier 56 is used to produce the second harmonic of the output on lead 31 from AM detector 28. This second harmonic output on lead 57 is used as an input to a two-quadrant analog multiplier 58 with the phase-related signal on lead 53 being the other input. The resulting envelope modulated second harmonic is combined with the fundamental signal on lead 31 in summing amplifier 59, producing a composite output on lead 60.

Obviously, higher harmonics can be generated by the use of additional four-quadrant multipliers, and the techniques of the examples described hereinabove may be combined to give separate control of any number of harmonics of the signal from an individual string. Again, this is possible only because the RF pickup technique provides individual outputs from each string.

Figure 10:
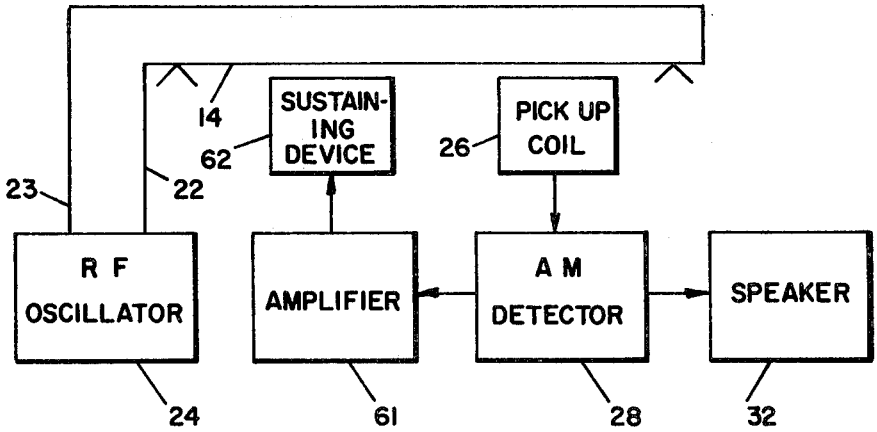
FIG. 10 is a block diagram showing the sound system of this invention having vibration sustaining means included therewith.

FIG. 10 shows a further embodiment of this invention that is shown in connection with FIGS. 1 and 2 but could be utilized with any of the embodiments described hereinabove.

As shown in FIG. 10, RF oscillator 24 is connected with a string 14 of guitar 12 in the same manner as described in connection with the embodiment shown in FIGS. 1 and 2. Thus, pickup coil 26 is positioned adjacent to string 14 and provides an RF signal of varying amplitude to AM detector 28 which, in turn, provides an audio signal which may be used, for example, to drive speaker 32.

Figure 11:
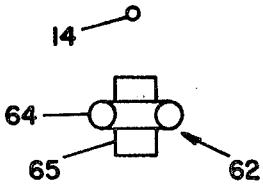
FIG. 11 is a partial cross-section view of the vibration sustaining device and string illustrating positioning of the device with respect to the string.

As shown in FIG. 10, AM detector 28 also provides an output through amplifier 61 to vibration sustaining device 62. As shown in partial cross-section in FIG. 11, vibration sustaining device 62 includes a coil 64 wrapped around a permanent magnet 65 and it is positioned adjacent to the same string as is coil 26. A separate vibration sustaining device may be provided for each string. Permanent magnet 65 exerts a force on string 14, the amount of force being varied by electrical current in coil 64. Thus, the signal from amplifier 61 varies the force exerted on string 14 by sustaining device 62 and alters the string's vibration.

Different effects may be obtained by varying the phase, amplitude, or harmonic content of the signal used to drive the sustaining device. For example, an analog multiplier may be used to generate the second harmonic of the signal from AM detector 28 as in FIG. 9. The second harmonic could then be used to drive the sustaining device. The resulting force on string 14 from sustaining device 62 would cause it to vibrate in an overtone mode.

The vibration sustaining device must be used with an RF type pickup. If used with a conventional pickup, the string would inductively couple the sustaining device to the pickup thus producing spurious oscillations.

While not shown in detail herein, it is to be realized that modifications could be made to the system of this invention as needed or desired, and that such modifications as would be obvious are intended to be within the scope of this invention. For example, a number of oscillators could be connected with one string, and a single multiple pickup could be used for several strings rather than using separate pickups (each pickup coil would be part of an L-C resonant circuit tuned to the frequency of its associated string).

In operation, the output leads of an RF oscillator are connected to opposite leads of a metallic string (or a plurality of output leads for a plurality of oscillators are connected to different metallic strings) of the musical instrument such as a guitar to place an RF current on the strings. The pickup coil (or coils for multiple strings) is then positioned adjacent to the string (or to each of a plurality of strings where multiple coils are utilized) so that an RF signal of varying amplitude is induced in the coil when the string is vibrated during playing of the instrument. The RF signal is then detected and sound produced therefrom. A stereo effect is produced by placing dual pickup coils normal to one another and adjacent to a selected string or strings, and vibration of the selected string or strings can be maintained by use of the oscillation sustaining device as described.

The oscillators can be positioned anywhere conveniently close to the musical instrument utilizing output leads 22 and 23 of sufficient length to permit movement of the instrument by a musician as desired. The pickup coil or coils 26 (and/or 36) are mounted adjacent to a portion of the string that vibrates when the instrument is played, and may be connected, for example, on the body or neck of the guitar as indicated in the drawings. The signal processing circuitry (which includes AM detectors and filters) may also be positioned anywhere conveniently close to the musical instrument utilizing leads 29 of convenient length to again permit movement of the instrument as desired by a musician.

In view of the foregoing, it can be appreciated that this invention provides a novel sound system for a musical instrument such as a guitar.

What is claimed is:

1. An electronic sound generating system for a musical instrument having at least one electrically conductive string, said system comprising:

RF signal producing means providing an output signal at an RF frequency;

means for connecting said RF signal producing means with an electrically conductive string of a musical instrument so that when so connected said output signal from said RF signal producing means is impressed upon said string;

first sensing means positionable adjacent to said string of said musical instrument so that when so positioned said sensing means senses vibratory motion of said string and produces an output signal dependent upon said sensed vibratory motion of said string;

second sensing means positionable adjacent to said string of said musical instrument and normal to said first sensing means so that when so positioned said second sensing means senses vibratory motion of said string and produces an output indicative thereof; and signal processing means connected with said first and second sensing means to receive the output therefrom and produce a stereo output for utilization purposes.

2. The sound system of claim 1 wherein said RF signal producing means is an RF oscillator.

3. The sound system of claim 1 wherein said sensing means are pickup coils normally positioned with respect to one another.

4. The sound system of claim 1 wherein said signal processing means includes an AM detector, and wherein said signal processing means produces an audio output.

5. The sound system of claim 1 wherein said system is utilized with a guitar having metallic strings.

6. The sound system of claim 1 wherein said signal processing means includes an analog multiplier and a low pass filter for receiving the outputs from said sensors and providing a signal related to the phase and amplitude differences between said outputs.

7. The sound system of claim 1 wherein said signal processing means includes at least one analog multiplier and at least one summing amplifier to control the amplitude, phase and harmonic content of said output signal from said signal processing means.

8. The sound system of claim 1 wherein said musical instrument has at least two electrically conductive strings, third sensing means positionable adjacent to said second string of said musical instrument, and wherein said signal processing means receives the outputs from all of said sensing means.

9. The sound system of claim 8 wherein said system includes a second RF signal producing means and a second means for connecting said second RF signal producing means with said second string of said musical instrument, with said second string being other than the string having said first RF signal producing means connected therewith.

10. The sound system of claim 9 wherein said second RF signal producing means produces an output signal at an RF frequency other than that provided by said first RF signal producing means, and wherein said signal processing means includes first and second filters connected with said first and second sensors, said first filter passing substantially only said frequency generated by said first RF signal producing means and wherein said second filter passes substantially only the frequency produced by said second RF signal producing means.

11. The sound system of claim 1 wherein said system includes vibration sustaining means.

12. The sound system of claim 11 wherein said vibration sustaining means includes an amplifier connected with the output of said signal processing means and a coil wound about a permanent magnet and positioned adjacent to said string.

13. An electronic sound generating system for a musical instrument having at least two electrically conductive strings said system comprising:

a first RF oscillator providing an output signal at an RF frequency and having a substantially constant amplitude;

first means for connecting said RF oscillator with a first electrically conductive string of a musical instrument so that when so connected said output signal from said RF oscillator is impressed upon said string;

a first pickup coil positionable adjacent to said first string of said musical instrument so that when so positioned said pickup coil is inductively coupled to said first string to sense vibratory motion of said first string and producing an output signal having amplitude variations which are dependent upon said sensed vibratory motion of said first string;

a first AM detector connected with said pickup coil to sense amplitude variations of said output signal from said pickup coil and producing an audio output signal in response thereto;

a second RF oscillator;

second means for connecting said second RF oscillator with a second one of said strings of said musical instrument with said second string being other than said first string having said first RF oscillator connected therewith;

a second pickup coil positionable adjacent to said second string of said musical instrument;

a second AM detector connected with said second pickup coil; and means for receiving said audio output signal from said AM detectors for utilization purposes.

14. The electronic sound generating system of claim 13 wherein said last named means includes speaker means for providing an audible output in response to said audio output signal received from said AM detectors.

15. The sound system of claim 13 wherein said system includes third and fourth pickup coils positionable adjacent to said first and second strings of said musical instrument and normal to said first and second pickup coils so that when so positioned said third and fourth pickup coils are inductively coupled to said first and second strings to sense vibratory motion of said strings and producing an output signal having amplitude variations which are dependent upon said sensed vibratory motion of said strings in a plane normal to that sensed by said first and second pickup coils, said system also including third and fourth AM detectors connected with said third and fourth pickup coils to sense amplitude variations of said output signals from said third and fourth pickup coils and producing audio output signals in response thereto.

16. The sound system of claim 13 wherein said second RF oscillator produces an output signal at an RF frequency other than that produced by said first RF oscillator, and wherein said system includes first and second filters connected with said first and second pickup coils, said first filter passing substantially only said RF frequency of said first RF oscillator and said second filter passing substantially said RF frequency of said second RF oscillator.

17. The sound system of claim 13 wherein said system includes vibration sustaining means, said vibration sustaining means including an amplifier connected with the outputs of said AM detectors and a coil wound about a permanent magnet and positioned adjacent to said strings.

* * * * *